United States Patent [19]

Gans et al.

[11] 4,410,894

[45] Oct. 18, 1983

[54] ARRAY PHASING TECHNIQUES FOR WIDE AREA COVERAGE IN A FAILURE MODE

[75] Inventors: Michael J. Gans, Monmouth Beach Twp., Monmouth County; Arno A. Penzias, Highland Park, both of N.J.

[73] Assignee: Bell Telephone Laboratories, Incorporated, Murry Hill, N.J.

[21] Appl. No.: 234,682

[22] Filed: Feb. 17, 1981

[51] Int. Cl.[3] ..... H01Q 3/36

[52] U.S. Cl. ..... 343/368

[58] Field of Search ..... 343/853, 854, DIG. 2, 343/100 ST, 100 SH

[56] References Cited

U.S. PATENT DOCUMENTS

| | | | |
|---|---|---|---|
| 3,041,605 | 6/1962 | Goodwin et al. | 343/854 |
| 3,056,961 | 10/1962 | Mitchell | 343/854 |
| 3,119,965 | 1/1964 | Phillips | 455/105 |

OTHER PUBLICATIONS

Reudink et al.; A Scanning Spot-Beam Satellite System; BSTJ, vol. 56, No. 8, Oct. 1977, pp. 1549–1560.

*Primary Examiner*—Eli Lieberman

*Attorney, Agent, or Firm*—Erwin W. Pfeifle

[57] ABSTRACT

The present invention relates to an array phasing technique which normally provides directional spotbeams, and in the event of a failure mode of a phase shift controller for providing a wide area coverage beam. In an arrangement for practicing the present technique, each array feed element has disposed at its input a serial arrangement of a fixed value phase shifter (32) and a variable phase shifter (34). Each variable phase shifter has a separate control signal supplied to it by a phase shift controller (36). During normal operation the combined fixed value and variable phase shifters cause the array to radiate a flat wavefront in a predetermined direction, and in a failure mode of the phase shift controller the fixed phase shifters cause the array to radiate a diverging area coverage beam.

2 Claims, 3 Drawing Figures

ARRAY PHASING TECHNIQUES FOR WIDE AREA COVERAGE IN A FAILURE MODE

BACKGROUND OF THE INVENTION

1. Field of the Invention

The present invention relates to techniques for phasing the elements of a phased array antenna to provide wide area coverage in a failure mode and, more particularly, to techniques for locking each of the plurality of phase shifters of a phased array antenna to a separate predetermined phase shift value in a manner whereby the combined radiations from all array elements produce a curved wavefront such as, for example, a spherical wavefront which provides an area coverage beam rather than the usual flat, or planar, wavefront.

2. Description of the Prior Art

Phased array antennas are used for many applications and have been proposed for use in satellites for directing beams to various earth stations in a communication system. For example, in the article "A Scanning Spot-Beam Satellite System" by D. O. Reudink et al in *The Bell System Technical Journal,* Vol. 56, No. 8, October 1977 at pages 1549–1560 the use of a phased array antenna for providing a scanning spot beam which is scanned over a service region on the earth was proposed. There, the advantage of the scanning beam over an area coverage beam was stated as the use of less RF power and a concomitant reduction in required electrical power generation equipment weight, and of experiencing a gradual decrease in power as individual elements of the antenna system fail; i.e., it is a system which fails "gracefully" because of the built in redundancy of the many elements in the phased array. However, the failure of an electrical component which provides a signal to the phased array antenna could stop the signal flow altogether until repaired or replaced.

U.S. Pat. No. 3,119,965, issued to E. N. Phillips on Jan. 28, 1964, relates to an arrangement using an active power splitter for applying an input signal in parallel paths to an antenna array. The patent states that, in the disclosed arrangement, an output signal from a frequency generator is applied to an active ultra-high-frequency power dividing device having a plurality of output ports. Each output port of the power splitter is connected to one element of an antenna array which provides a directional ultra-high-frequency radiation. The active power splitter can provide amplification of the ultra-high-frequency signal and additional amplification can be provided for each of the parallel signals between the output ports and their respective antenna elements. This additional amplification can be selectively controlled externally, either to maintain the amplification of all the parallel output signals constant or to vary the amplification of the output signals relative to each other. In addition, the relative phases of the parallel output signals can be controlled selectively externally either to maintain all output signals in phase or to change the relative phases of the output signals in order to alter the directivity of the antenna array.

One unit, however, contained in, for example, a scanning spot beam satellite system for which it is difficult to provide redundancy is the on-board computer which controls the phase shifters of the phased array antenna because of its complexity of operation and size. The problem remaining in the prior art, therefore, is to provide a technique which allows continued operation of the phased array antenna system upon the failure of a phase shifter controller for providing signal transmissions to each of the spaced-apart remote receivers.

SUMMARY OF THE INVENTION

The foregoing problem was solved in accordance with the present invention which relates to techniques for phasing the elements of a phased array antenna to provide wide area coverage in a failure mode and, more particularly, to techniques for locking each of a plurality of phase shifters of a phased array antenna to a separate predetermined phase shift value in a manner whereby the combined radiation from all array elements produce a curved wavefront as, for example, a spherical wavefront which provides an area coverage beam rather than the usual flat, or planar, wavefront.

It is an aspect of the present invention to provide a back-up mode of operation for a phased array antenna, in the event of the failure of the associated phase shifter controller, which permits all array elements and amplifiers to remain in operation as usual except that the phase shifters would become locked at values which essentially produce a spherical or other curved phase front over the array, rather than the usual flat, or planar, wavefront.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

As was described hereinbefore, it is difficult to provide redundancy of an on-board computer in a satellite which controls the phase shifters of a phased array antenna. To overcome this problem, the present invention provides a phased array antenna arrangement which transmits or receives planar directional wavefronts while the phase shift controller is functioning and provides a back-up mode of operation in the event of a phase shift controller failure by causing the array phase shifters to be fixed at proper levels to cause the array to provide a generally uniform coverage of the overall satellite system service area using, for example, a beam formed by a spherical wavefront. Since the beamwidth for an area coverage beam is much larger than that of a spotbeam, the antenna gain would drop considerably. However, by the concurrent use of reduced bandwidth transmissions, the satellite would be able to continue relaying communications at a reduced capacity throughout the overall system service area. A simple method of broadening the beamwidth is to turn off all but one of the array elements, since an individual element is designed just small enough to give roughly uniform coverage of a service area. This strategy is acceptable for satellite reception provided the unused preamplifiers are also turned off to prevent them from contributing front-end noise, but is not acceptable for satellite transmission because turning off nearly all the power amplifiers greatly reduces the total transmitted power. An alternative is to turn on a separate standby traveling wave tube (TWT) with total power capacity and feed it to a separate standby horn antenna with overall service area coverage. However, connection of a standby transponder into the satellite communications system after possibly several years of standing idle is a high risk concept.

The array phasing technique employed in the event of a phase shift controller failure in accordance with the present invention, avoids the problems of reduced power and high risk mentioned hereinabove. All array elements and amplifiers would remain in operation as usual except that the phase shifters would provide separate fixed values which produce a predetermined spherical or other curved wavefront over the array rather than the usual flat wavefront for producing a spotbeam.

Figure 1:
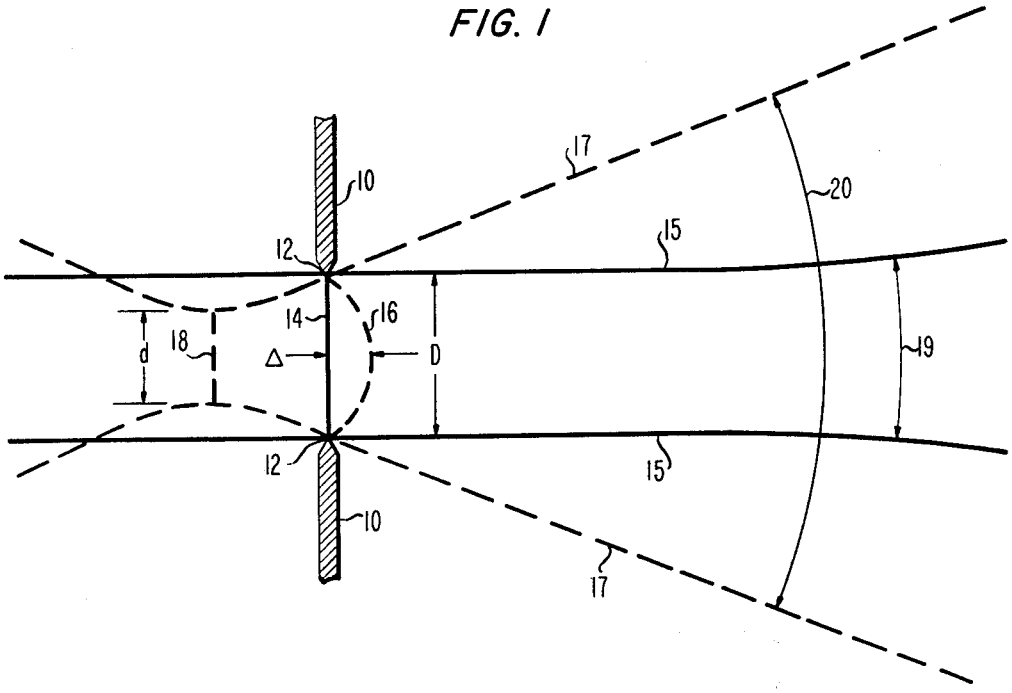
FIG. 1 illustrates that from Gaussian beam theory the first order effect of a spherical wavefront is to broaden the antenna beamwidth over the beamwidth produced by a planar wavefront.

To provide a clear understanding of the implementation of the present invention, a brief review of pertinent points and formulas associated with Gaussian beam theory is presented in association with FIG. 1. In FIG. 1, an antenna array aperture plane 10 is truncated to provide an aperture 12 of diameter D through which a planar wavefront 14 of a directional spotbeam 15, or a spherical wavefront 16 of an area coverage beam 17 having a central deviation distance from a flat wavefront equal to Δ, can pass. Spherical beam 17 is shown projected through aperture 12 to the left to produce a normal flat wavefront 18 of a diameter d before expanding outward again in a spherical beam. The external border lines of each of beams 15 and 17 are representative of an exemplary −15 dB beam envelope.

From Gaussian beam theory, the first order effect of a spherical wavefront 16, used exclusively for descriptive purposes only hereinafter, is to broaden the antenna beamwidth over that obtained from a flat wavefront 14 as shown in FIG. 1. Approximate formulas for beamwidth broadening based on gaussian beam formulas for an untruncated aperture can be provided for the truncated aperture. The beamwidth 19 of beam 15 can be expressed as:

$$\text{Planar Wavefront Beamwidth} = \frac{3\lambda \ln 10}{\pi D} \quad (1)$$

where λ is the free space wavelength of the signal being transmitted or received in the beam. The broadened beamwidth 20 of spherical beam 17 can be expressed as:

$$\text{Broadened Beamwidth} = \frac{3\lambda \ln 10}{\pi d} \quad (2)$$

and the diameter d of flat wavefront 18 can be determined from $$d = D\left\{1 + \left[\frac{8\pi\Delta}{3\lambda \ln 10}\right]^2\right\}^{-\frac{1}{2}} \quad (3)$$

The effect of aperture truncation is to distort the gaussian beam shape and add sidelobes. When the aperture 12 is smaller, the stronger truncation effects cause the radiation patterns to fluctuate and exhibit high sidelobes. In order to obtain low sidelobes, it is usually desirable to maintain an edge taper of about −15 dB or less for which values the gaussian beam formulas (1), (2) and (3) provide a good approximation of the radiation pattern.

Figure 2:
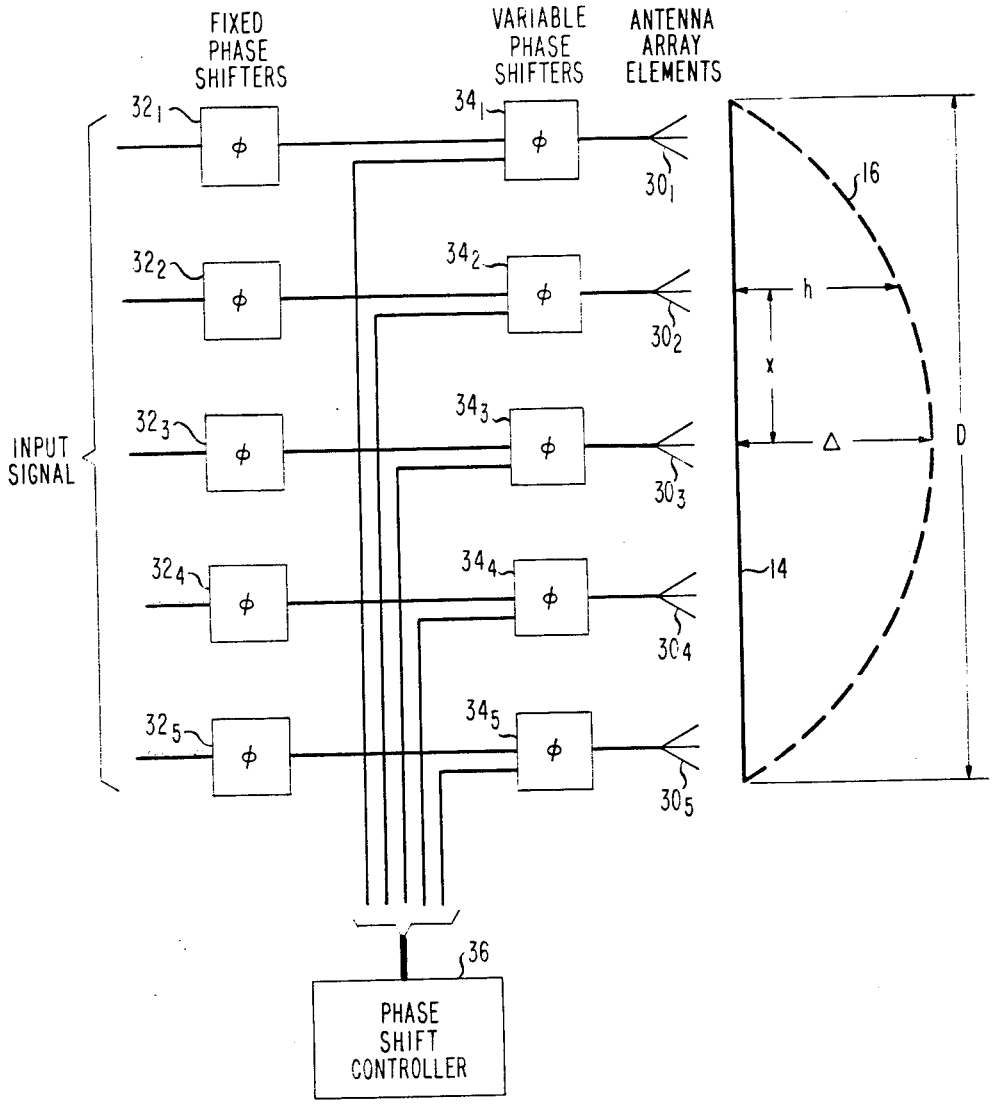
FIG. 2 is a block diagram of a phased array antenna arrangement which provides a directional spotbeam under normal operation and an area coverage beam rather than a spotbeam upon failure of the phase shift controller in accordance with the present invention.

A phased array antenna arrangement comprising only five feed elements $\mathbf{30_1}$–$\mathbf{30_5}$, for exemplary purposes only, for practicing the present invention is shown in FIG. 2. In FIG. 2, an input signal is transmitted through each of five fixed value phase shifters $\mathbf{32_1}$–$\mathbf{32_5}$ and five variable phase shifters $\mathbf{34_1}$–$\mathbf{34_5}$ to antenna elements $\mathbf{30_1}$–$\mathbf{30_5}$, respectively. Each of the fixed value phase shifters $\mathbf{32_1}$–$\mathbf{32_5}$ have a separate predetermined phase shift value which will cause, without the addition of the phase shift provided by the associated variable phase shifter $\mathbf{34_1}$–$\mathbf{34_5}$, the antenna elements to radiate the input signal via a spherical wavefront 16 having a distance at its center of a value Δ from the array aperture plane 10. Variable phase shifters $\mathbf{34_1}$–$\mathbf{34_5}$ are each under the control of a phase shift controller 36 which, when operational, provides a signal to each of variable phase shifters $\mathbf{34_1}$–$\mathbf{34_5}$ to provide a phase shift, which when added to the phase shift provided by the corresponding one of the fixed value phase shifters $\mathbf{32_1}$–$\mathbf{32_5}$, will cause the antenna elements to radiate the input signal via a flat, or planar, wavefront 14 which propagates in a predetermined direction. Therefore, with all of elements 30, 32, 34 and 36 in operation, the antenna arrangement of FIG. 2 can radiate a spotbeam 15, shown in FIG. 1, which can be scanned over a predetermined remote service area in an exemplary time division multiple access (TDMA) format. However, when phase shift controller 36 fails, variable phase shifters $\mathbf{34_1}$–$\mathbf{34_5}$ do not provide any phase shift to a signal propagating therethrough, and the phase shifts introduced by fixed value phase shifters $\mathbf{32_1}$–$\mathbf{32_5}$ cause antenna elements $\mathbf{30_1}$–$\mathbf{30_5}$ to radiate a diverging area coverage beam 17, shown in FIG. 1, covering the entire remote service area to provide continued communication capabilities. In such arrangement, all elements in all branches are functional, except for the variable phase shifters $\mathbf{34_1}$–$\mathbf{34_5}$.

To determine the phase shift that should be applied by each of the fixed value phase shifters $\mathbf{32_1}$–$\mathbf{32_5}$, the beamwidth necessary to cover the overall service area with a divergent beam 17 should be determined, and once such beamwidth has been determined then the magnitude of the diameter "d" for flat wavefront 18 of the divergent spherical beam can be derived from equation (2). From the value of "d" just derived, the magnitude of the distance Δ between the planar wavefront at aperture plane 10 and the center of the spherical wavefront 16 can be determined from equation (3).

Figure 3:
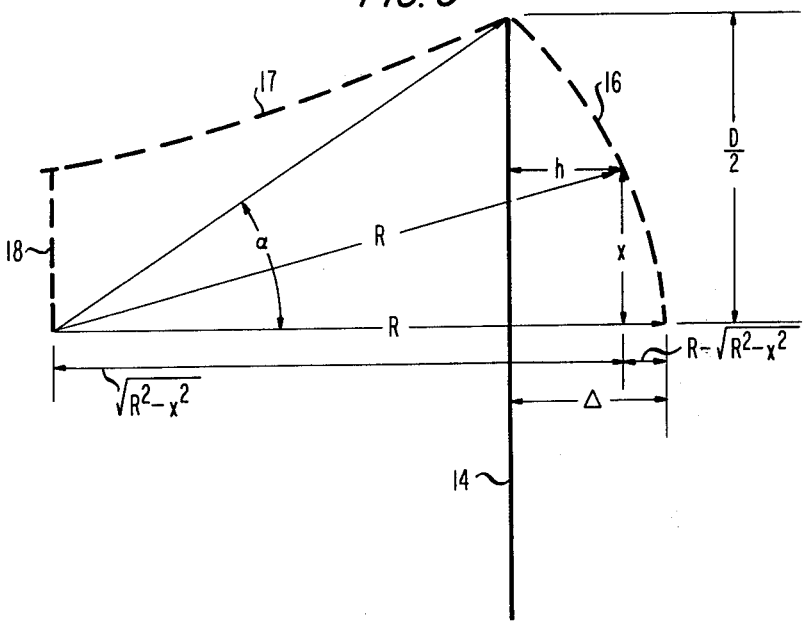
FIG. 3 is a diagram of the wavefronts of FIG. 2 for illustrating the technique of deriving the individual phase shifts to be used in each of the fixed phase shifters in the arrangement of FIG. 2 for a spherical beam in accordance with the present invention.

The diagram of FIG. 3, illustrating various elements of the spherical wavefront 16, will be used hereinafter to clarify the derivation of the individual phase shift values used for each of the fixed value phase shifters $\mathbf{32_1}$–$\mathbf{32_5}$ of FIG. 2. To illustrate such fixed phase shift derivation, from FIG. 3 the angle α between the centerline of spherical beam 17 and the line intersecting the points at aperture edge 12 and the centerline at flat wavefront 18 is used in conjunction with standard trigonometric formulas to generate the expressions:

$$\cos\alpha = \frac{R-\Delta}{R}, \text{ and} \tag{4}$$

$$\sin\alpha = \frac{D}{2R}, \tag{5}$$

where R is the radius of the spherical wavefront at the antenna aperture. Using the expression $\sin^2\alpha+\cos^2\alpha=1$ and substituting the values of equations (4) and (5) therein produces the expression:

$$\left(\frac{R-\Delta}{R}\right)^2 + \frac{D^2}{4R^2} = 1 \tag{6}$$

and solving for R yields:

$$R = \frac{\Delta^2 + \frac{D^2}{4}}{2\Delta}. \tag{7}$$

The phase shift at the center of spherical beam 17 at the aperture of the antenna can be determined from:

$$\phi_{center} = \frac{2\pi\Delta}{\lambda} \text{ radians.} \tag{8}$$

The longitudinal distance h between the aperture plane 10 and a desired spherical wavefront at a feed element 30 located a distance x from the center of the aperture can be determined from:

$$h = \Delta - \frac{x^2}{2R}. \tag{9}$$

From equation (8) it can be seen that the phase at a radial distance x from the center of the aperture of the antenna needed to produce a spherical wavefront can be determined from:

$$\phi_x = \frac{2\pi h}{\lambda} \tag{10}$$

and substituting for R and h in equation (10) using the values determined in equations (7) and (9), respectively, the required phase shift at any feed element needed to produce a desired spherical wavefront and corresponding area coverage beam can be determined from:

$$\phi_x = \frac{2\pi\Delta}{\lambda}\left[1 - \frac{x^2}{\Delta^2 + \left(\frac{D}{2}\right)^2}\right]. \tag{11}$$

It is to be understood that in an actual phased array, the continuous spherical wavefront considered hereinabove can only be approximated by point matching the phase of each element of the wavefront phase at the center of each feed element 30. It is to be understood that other types of diverging area coverage beams can be adopted rather than the spherical beam for providing a back-up mode of operation and still fall within the spirit and scope of the present invention. For example, unequal beam broadening can be obtained in the principle planes by matching an ellipsoidal wavefront rather than a spherical wavefront, as in the case of use with gaussian beams with simple astigmatism. It is to be further understood that if the design phase shift values chosen provide a possible null in gain near the edge of coverage due to resultant sidelobes, then the design fixed phase shift values can be slightly altered to avoid such null. It will be found that with the present invention, the performance provided by an antenna arrangement of FIG. 2 will be much greater than that provided by a single element for providing an area coverage beam. Additionally, it is to be understood that the associated phase shifters 32 and 34 in each branch can be formed from different sections of a single phase shifter and can use any suitable circuit arrangement. It is to be further understood that the scope of the present invention also includes only using fixed value phase shifters 32 without variable phase shifters 34 for providing a continuous area coverage beam with the phased array antenna.

What is claimed is:

1. A phased array antenna arrangement comprising:

a plurality of feed elements (30) disposed to form a phased array;

a plurality of variable phase shifting means (34), each variable phase shifting means being coupled to a separate one of the plurality of feed elements and capable of introducing a separate predetermined phase shift to a signal propagating therethrough in response to an input control signal; and a phase shift controller (36) capable of generating separate control signals to each of the plurality of variable phase shifting means for causing each variable phase shifting means to introduce a separate predetermined phase shift in the signal propagating therethrough such that the plurality of feed elements will radiate or receive a predetermined planar directional wavefront at any instant of time characterized in that the antenna arrangement further comprises:

a plurality of fixed value phase shifting means (32), each fixed value phase shifting means being coupled in a path associated with a separate one of the plurality of separately coupled variable phase shifting means and feed elements for causing a predetermined separate fixed phase shift to be continuously applied to a signal propagating therethrough such that, in the absence of a phase shift being introduced by each of the plurality of variable phase shifting means into the signal propagating therethrough, the individual phase shifts introduced by said plurality of fixed value phase shifting means will cause the plurality of feed elements to radiate or receive a predetermined curved wavefront which is associated with a predetermined wide area coverage beam.

2. A phased array antenna arrangement according to claim 1 where the plurality of feed elements are disposed to provide a phased array comprising an aperture of a width D in a principle plane thereof characterized in that the predetermined curved wavefront at the aperture of the phased array is a spherical wavefront, and each of the plurality of fixed value phase shifting means introduces a phase shift, $\phi_x$, into a signal propagating therethrough which approximately corresponds to $$\phi_x = \frac{2\pi\Delta}{\lambda}\left[1 - \frac{x^2}{\Delta^2 + \left(\frac{D}{2}\right)^2}\right]$$

where λ is the free space wavelength of said signal, Δ is the longitudinal distance between the center of the spherical wavefront at the aperture and an aperture plane of the phased array, and x is the radial distance between a feed element associated with a particular fixed value phase shifting means and the center of the phased array.

* * * * *